US009289736B1

(12) United States Patent
Eisen et al.

(10) Patent No.: US 9,289,736 B1
(45) Date of Patent: Mar. 22, 2016

(54) NAIL POLISH MIXING APPARATUS

(71) Applicant: Izen Consulting, Inc., Boca Raton, FL (US)

(72) Inventors: Dennis K. Eisen, Delray Beach, FL (US); Gavril A. Horvath, Tarzana, CA (US)

(73) Assignee: IZEN CONSULTING, INC., Boca Raton, FL (US)

( * ) Notice: Subject to any disclaimer, the term of this patent is extended or adjusted under 35 U.S.C. 154(b) by 0 days.

(21) Appl. No.: 14/958,849

(22) Filed: Dec. 3, 2015

Related U.S. Application Data

(63) Continuation of application No. 13/671,204, filed on Nov. 7, 2012, now abandoned.

(51) Int. Cl.
*B01F 11/00* (2006.01)
*B01F 15/00* (2006.01)

(52) U.S. Cl.
CPC ..... *B01F 15/00409* (2013.01)

(58) Field of Classification Search
CPC ..... B01F 11/0008; B01F 11/0025; B01F 15/00409
USPC ..... 366/209, 216, 218
See application file for complete search history.

(56) References Cited

U.S. PATENT DOCUMENTS 982,156 A * 1/1911 Miltz ..... B01F 9/0025 366/216
1,354,613 A * 10/1920 Gibson ..... D06F 15/00 366/139
2,021,209 A * 11/1935 Taccogna ..... B01F 11/0025 366/197
2,029,234 A * 1/1936 Helmes ..... A47J 43/042 366/209
2,059,572 A * 11/1936 Flynt ..... A47J 43/042 366/209
2,848,019 A * 8/1958 Corbin ..... B01F 13/1058 141/100
3,331,588 A * 7/1967 Nasser ..... A45D 34/048 366/211
3,514,080 A * 5/1970 Szilagyi Bela ..... B01F 11/0054 366/169.1
5,066,136 A * 11/1991 Johnson ..... B01F 11/0005 366/209
5,238,302 A * 8/1993 Rohan ..... B01F 11/0008 366/110
5,268,620 A * 12/1993 Hellenberg ..... B01F 11/00 318/114
5,466,065 A * 11/1995 Catrombon ..... B01F 9/0014 366/209
5,662,416 A * 9/1997 Dwigans, II ..... B01F 11/0022 366/209
7,461,650 B1 * 12/2008 Rand ..... A61M 15/009 128/200.14
2002/0110046 A1 * 8/2002 Robertson ..... B01F 11/0005 366/110

* cited by examiner

*Primary Examiner* — David Sorkin
*Assistant Examiner* — Abbas Rashid
(74) *Attorney, Agent, or Firm* — Blakely Sokoloff Taylor & Zafman LLP

(57) ABSTRACT

A nail polish mixing apparatus for stirring the mixing balls and nail polish contained with a nail polish bottle comprises a base, a vertical support column having an opening defined by a slot, and a motor in connection with a first end of a shaft. A linkage includes a top end that is rotatably fixed to a guide pin sized and configured to move up and down within the slot, and a bottom end that is rotatably fixed to a peripheral edge of a wheel that is in connection with a second end of the shaft. A ring on the linkage is provided for securing the nail polish bottle. Upon activation, the motor rotates the wheel, causing the bottom end of the linkage to move in a circular motion and the top end of the linkage to move up and down, thereby mixing the contents in the nail polish bottle.

12 Claims, 6 Drawing Sheets

NAIL POLISH MIXING APPARATUS

BACKGROUND OF THE INVENTION

1. Field of the Invention

The present invention relates to nail polish and, more particularly, to an apparatus that automatically mixes a nail polish container to produce an ideal consistency for application of the nail polish to finger nails.

2. Discussion of the Related Art

Nail polish that is stored in a glass bottle will experience a settling process proportional to the amount of time the bottle remains in a sedentary state (not in use). For gel-based and lacquer-based nail polish products, the manufacturer generally recommends that a user manually shakes the bottle for a period of 60 seconds prior to applying the nail polish stored therein. Each bottle of nail polish typically includes one or more mixing balls for aiding the mixing process. The process of manually shaking a nail polish bottle can be aggravating and cumbersome in a professional environment such as a nail salon, and does not produce an ideal consistency for application of the nail polish to finger nails. While several devices for mixing nail polish stored in bottles have been developed, the majority of these devices, such as the U.S. Pat. No. 5,238,302 to Rohan, only vibrate the bottle, which does not adequately mix the nail polish.

Considering the shortcomings of presently available nail polish mixing devices, there exists a need for an apparatus for automatically oscillating a nail polish bottle in a combined vertical and lateral motion to produce better nail polish consistency for application to finger nails.

OBJECTS AND ADVANTAGES OF THE INVENTION

Considering the foregoing, it is a primary object of the present invention to provide a nail polish mixing apparatus that automatically mixes nail polish stored within a bottle.

It is a further object of the present invention to provide a nail polish mixing apparatus that oscillates a nail polish bottle in a combined vertical and lateral motion.

It is a further object of the present invention to provide a nail polish mixing apparatus that can hold various sizes of nail polish bottles.

These and other objects and advantages of the present invention are readily apparent with reference to the detailed description and accompanying drawings.

SUMMARY OF THE INVENTION

The present invention is directed to a nail polish mixing apparatus for automatically mixing nail polish stored within a nail polish bottle. The mixing apparatus includes a weighted base supporting a motor and a bottle holder structured for securely holding a bottle of nail polish during the mixing process. When the apparatus is activated, the proximal end of the bottle holder moves in a circular motion about a rotating wheel as the distal end of the bottle holder freely moves up and down within a vertical slot in response to the circular movement of the proximal end of the holder, thereby causing a secured bottle to oscillate in a combined vertical and lateral motion that stirs the mixing balls within the bottle to produce an ideal consistency of nail polish. In a preferred embodiment, the motor moves a shaft that rotates the wheel at 500 rpm (revolutions per minute) for one minute during the mixing process and then automatically turns off.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Referring the several views of the drawings, the nail polish mixing apparatus of the present invention is shown and is generally indicated as 10.

Figure 1:
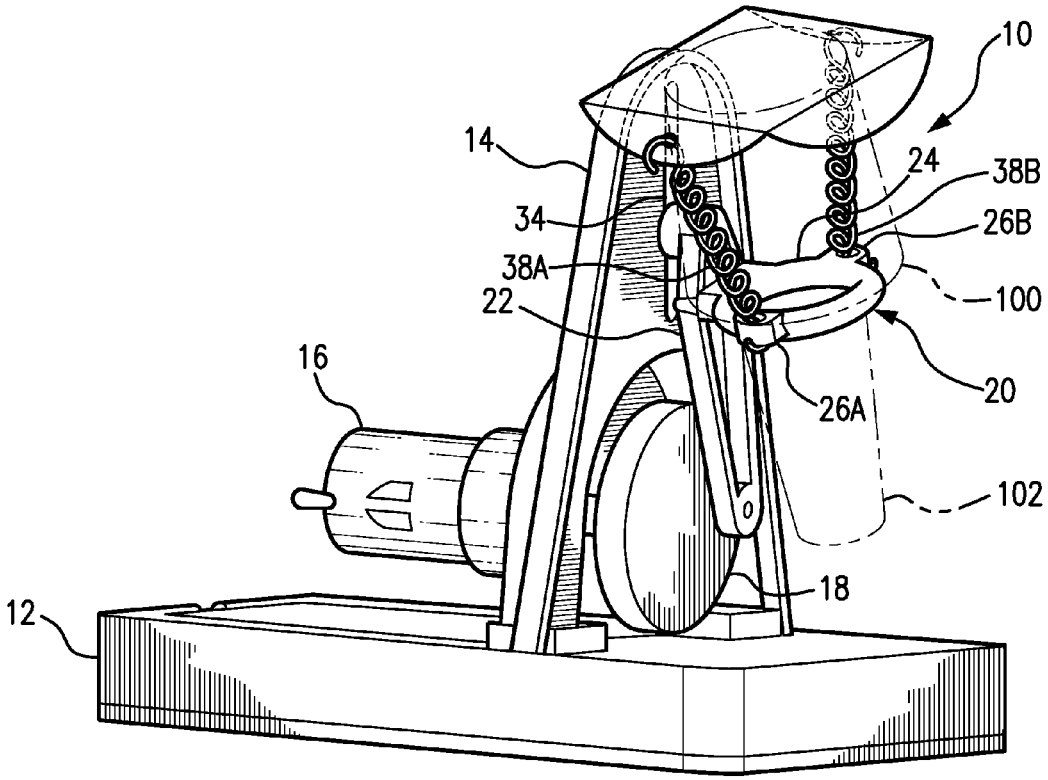
FIG. 1 is a perspective view illustrating the nail polish mixing apparatus of the present invention.
Figure 2:
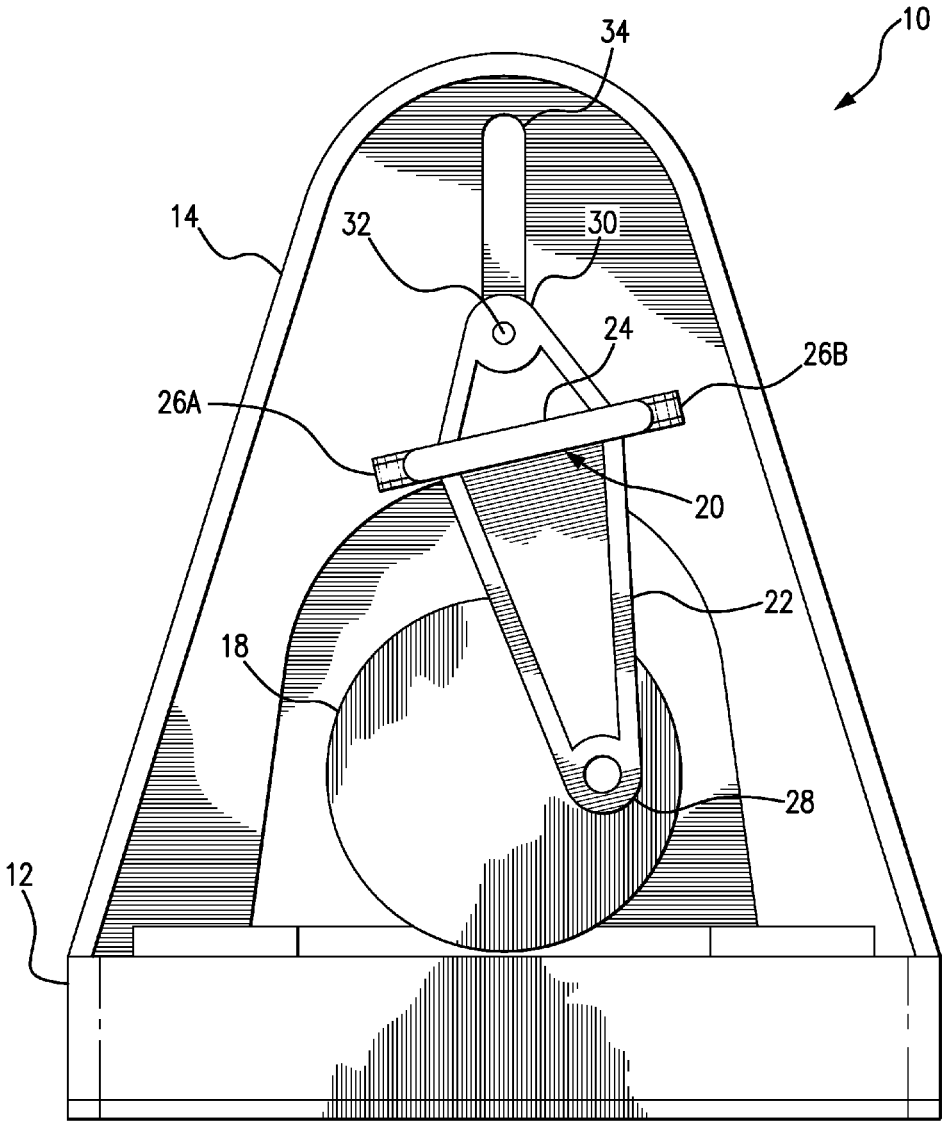
FIG. 2 is an elevated front side view illustrating the nail polish mixing apparatus of the present invention.

Referring initially to FIGS. 1 and 2, the nail polish mixing apparatus 10 includes a base 12, a vertical support column 14, and a motor 16 in connection with a wheel 18. A bottle holder 20 is structured for securely holding a nail polish bottle 100 and includes linkage 22, ring 24, and spring hooks 26A and 26B. The proximal end 28 of linkage 22 is rotatably fixed to wheel 18. The distal end 30 of linkage 22 is rotatably fixed to guide pin 32, which is freely movable within slot 34.

Figure 3:
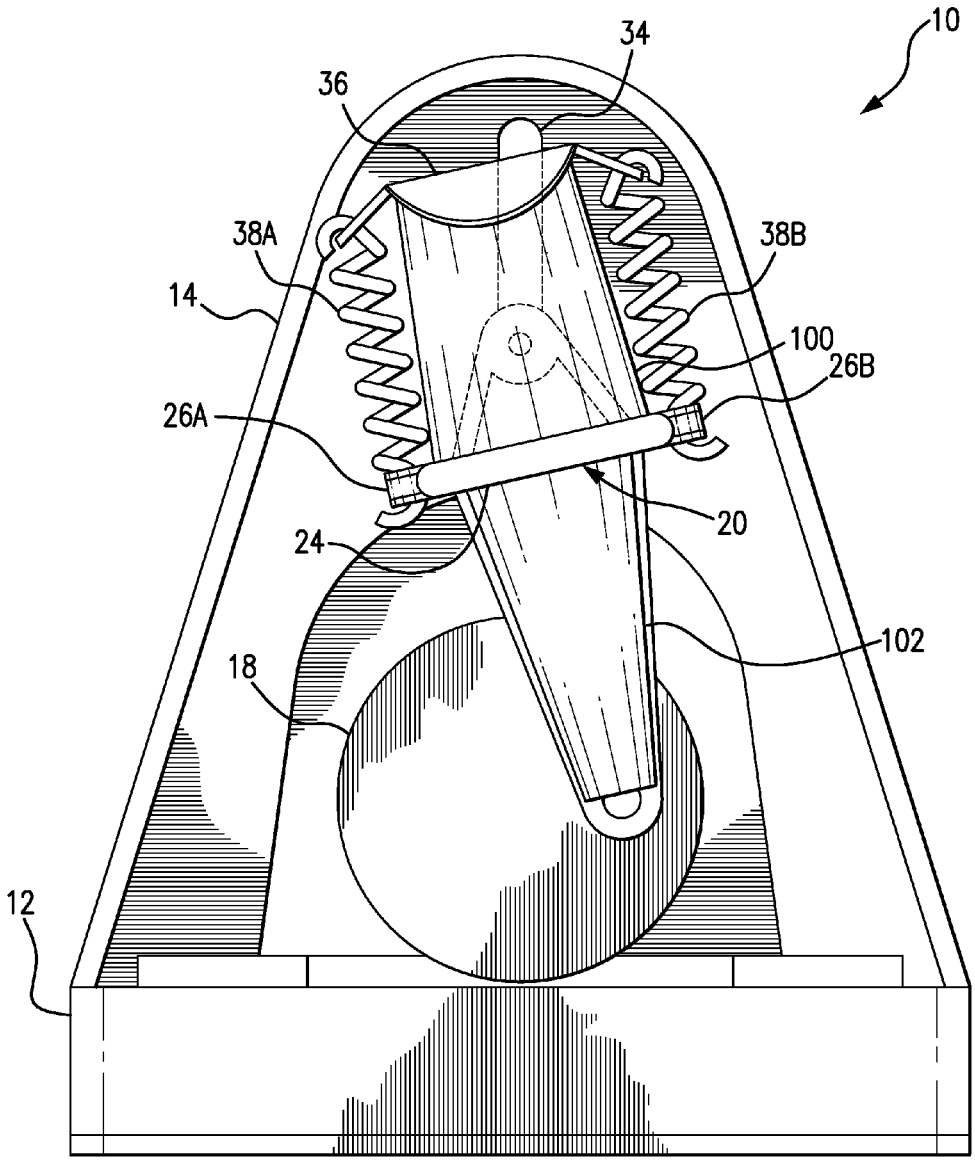
FIG. 3 is an elevated front side view illustrating the nail polish mixing apparatus of the present invention with a secured nail polish bottle.

Referring to FIG. 3, a nail polish bottle 100 is secured upside down within ring 24, whereby the cap 102 of the bottle 100 engages ring 24, and held in place by lid 36 and springs 38A and 38B, which are in connection with spring hooks 26A and 26B, respectively. The tension in springs 38A and 38B is sufficient to keep the nail polish bottle 100 secured between lid 36 and ring 24 during the mixing process.

Figure 4A:
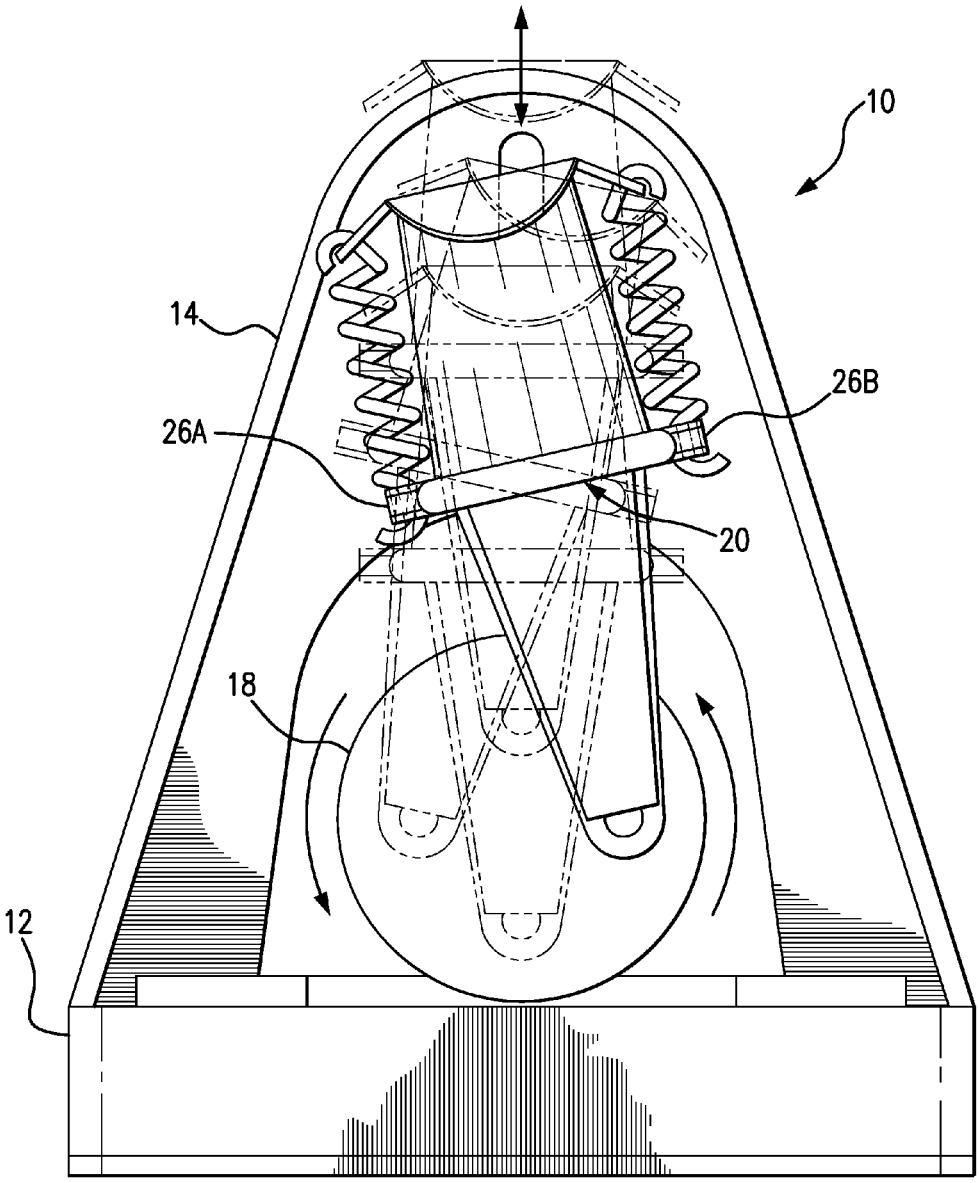
FIG. 4A is an elevated front side view illustrating the nail polish mixing apparatus of the present invention with a secured nail polish bottle and showing the path of the nail polish bottle in broken lines.
Figure 4B:
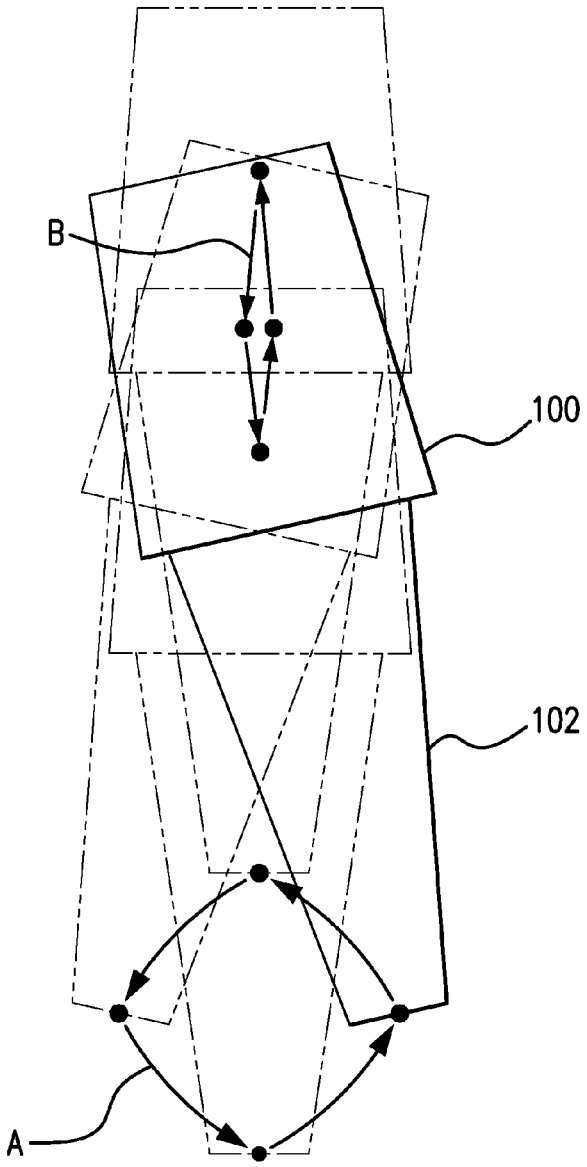
FIG. 4B is an isolated front elevational view illustrating the path of the nail polish bottle in broken lines with arrows indicating the movement of the nail polish bottle and nail polish bottle cap.

Referring to FIGS. 4A and 4B, when activated, the motor 16 turns a shaft (not shown) that is in connection with wheel 18, thereby causing wheel 18 to rotate. In a preferred embodiment, wheel 18 rotates at 500 rpm. As illustrated, the motor 16 moves the upper portion of the nail polish bottle 100 in a predominantly circular motion A causing the bottom portion of the nail polish bottle 100 to move in an up and down motion B along slot 34, thereby causing the bottle 100 to oscillate in a combined vertical and lateral motion that stirs the mixing balls (not shown) within the bottle 100 to produce an ideal consistency of nail polish. In a preferred embodiment, the motor 16 turns wheel 18 for a period of one minute when activated and automatically turns off thereafter.

Figure 5:
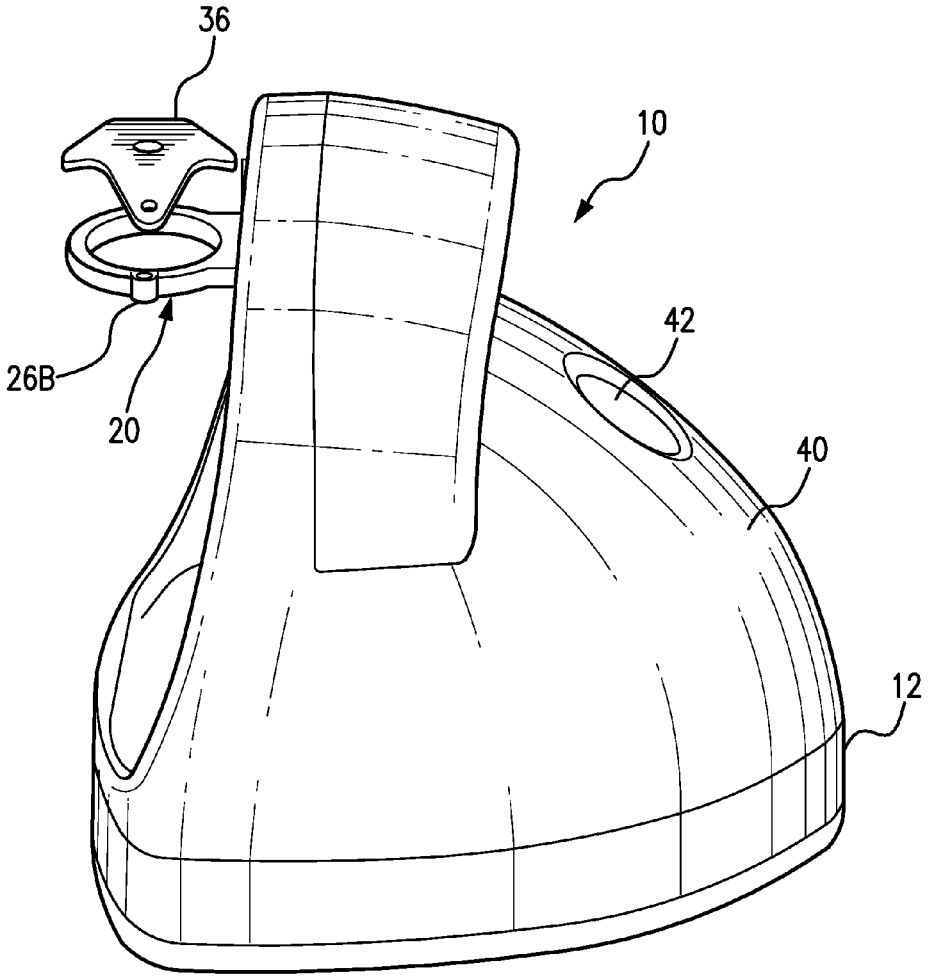
FIG. 5 is a side view illustrating the nail polish mixing apparatus of the present invention.

Referring to FIG. 5, the outer housing 40 is shown and may be fixed to the base 12 for concealing the motor 16. Button 42 is used to activate the motor 16, which is automatically deactivated after a mixing cycle. In one embodiment, the button 42 may be pressed a second time prior to automatic deactivation of the motor 16 for manual deactivation of the motor 16.

Base 12 is sufficiently weighted to prevent any movement of the base 12 and vertical support column 14 during the mixing process (i.e., as the motor 16 rotates the wheel 18).

In a preferred embodiment, the ring 24 is made of a semi-pliable material, such as rubber, to aid in securing a variety of different-sized nail polish bottles 100 the bottle holder 20.

In a preferred embodiment, the motor 16 of the nail polish mixing apparatus 10 is battery powered. In another embodiment, motor 16 is powered using an electrical plug in combination with a power outlet.

While the apparatus 10 has thus far been described as being used for mixing the contents of a nail polish bottle 100, the apparatus 10 could be configured to mix the fluid contents in other containers, as well.

While the present invention has been shown and described in accordance with several preferred and practical embodiments thereof, it is recognized that departures from the instant disclosure are fully contemplated within the spirit and scope of the invention as defined in the following claims and as interpreted under the Doctrine of Equivalence.

What is claimed is:

1. A nail polish mixing apparatus for stirring mixing balls and nail polish contained within a nail polish bottle, said nail polish mixing apparatus comprising:

a base;

a vertical support column on said base, and said vertical support column having a first opening at a bottom end and a second opening defined by a slot at a top end;

a motor coupled to a first end of a shaft, said motor configured to rotate the shaft when activated, the shaft extending through said first opening on said vertical support column;

a wheel coupled to a second end of the shaft;

a linkage having a top end and a bottom end, the top end of the linkage rotatably coupled to a guide pin that is sized and configured to move linearly within said slot, the bottom end of the linkage rotatably coupled adjacent to a peripheral edge of said wheel, said linkage configured so that the bottom end of the linkage is movable in a circular motion and the top end of the linkage is movable in a linear direction;

a ring on said linkage, and said ring configured for securing a nail polish bottle;

a button for activating said motor;

wherein activation of said motor causes the shaft to rotate said wheel, causing the bottom end of said linkage to move in a circular motion and the top end of said linkage to move, linearly within said slot for shaking the mixing balls and nail polish contained in said nail polish bottle secured by said ring, wherein the nail polish mixing apparatus further comprises a lid held together with said ring by a first spring and a second spring, and said lid being structured and disposed for keeping the nail polish bottle secured in said ring.

2. The nail polish mixing apparatus as recited in claim 1 further comprising a timer set to automatically deactivate said motor after a predetermined amount of time has lapsed.

3. The nail polish mixing apparatus as recited in claim 2 wherein said timer is set to deactivate said motor after one minute has lapsed.

4. The nail polish mixing apparatus as recited in claim 1 wherein said ring is sized and configured to receive the nail polish bottle upside down, whereby an upper portion of the nail polish bottle is downwardly inserted into said ring until the nail polish bottle is secured therein.

5. A nail polish mixing apparatus for stirring mixing balls and nail polish contained with a nail polish bottle, said nail polish mixing apparatus comprising:

a base;

a vertical support column on said base, and said vertical support column having a first opening at a bottom end and a second opening defined by a slot at a top end;

a motor coupled to a first end of a shaft, said motor configured to rotate the shaft when activated, the shaft extending through said first opening on said vertical support column;

a wheel coupled to a second end of the shaft;

a linkage having a top end and a bottom end, the top end of the linkage rotatably coupled to a guide pin that is sized and configured to move linearly within said slot, the bottom end of the linkage rotatably coupled adjacent to a peripheral edge of said wheel, said linkage configured so that the bottom end of the linkage is movable in a circular motion and the top end of the linkage is movable in a linear direction;

a nail polish bottle holder on said linkage, and said nail polish bottle holder being structured and disposed for securing a nail polish bottle, and said bottle holder comprising:

a ring; and a lid held together with said ring by a first spring and a second spring, and said lid configured to keep the nail polish bottle secured in said ring;

a button for activating said motor; and wherein activation of said motor causes the shaft to rotate said wheel, causing the bottom end of said linkage to move in a circular motion and the top end of said linkage to move, linearly within said slot for shaking the mixing balls and nail polish contained in said nail polish bottle secured by said ring.

6. The nail polish mixing apparatus as recited in claim 5 further comprising a timer set to automatically deactivate said motor after a predetermined amount of time has lapsed.

7. The nail polish mixing apparatus as recited in claim 6 wherein said timer is set to deactivate said motor after one minute has lapsed.

8. The nail polish mixing apparatus as recited in claim 5 wherein said ring is sized and configured to receive the nail polish bottle upside down, whereby an upper portion of the nail polish bottle is downwardly inserted into said ring until the nail polish bottle is secured therein.

9. A mixing apparatus for mixing fluids in a container, said mixing apparatus comprising:

a base;

a vertical support column on said base, and said vertical support column having a first opening at a bottom end and a second opening defined by a slot at a top end;

a motor coupled to a first end of a shaft, said motor configured to rotate the shaft when activated, the shaft extending through said first opening on said vertical support column;

a wheel coupled to a second end of the shaft;

a linkage having a top end and a bottom end, the top end of the linkage rotatably coupled to a guide pin that is sized and configured to move linearly within said slot, the bottom end of the linkage rotatably coupled adjacent to a peripheral edge of said wheel, said linkage configured so that the bottom end of the linkage is movable in a circular motion and the top end of the linkage is movable in a linear direction;

a ring on said linkage, and said ring configured for securing a container;

a button for activating said motor; and wherein activation of said motor causes the shaft to rotate said wheel, causing the bottom end of said linkage to move in a circular motion and the top end of said linkage to move linearly within said slot for mixing the fluids in the container secured by said ring, wherein the mixing apparatus further comprises a lid held together with said ring by a first spring and a second spring, and said lid being structured and disposed for keeping the container secured in said ring.

10. The mixing apparatus as recited in claim 9 further comprising a timer set to automatically deactivate said motor after a predetermined amount of time has lapsed.

11. The mixing apparatus as recited in claim 10 wherein said timer is set to deactivate said motor after one minute has lapsed.

12. The mixing apparatus as recited in claim 9 wherein said ring is sized and configured to receive the container upside down, whereby an upper portion of the container is downwardly inserted into said ring until the container is secured therein.

* * * * *